US011205358B2

(12) United States Patent
Dai

(10) Patent No.: US 11,205,358 B2
(45) Date of Patent: Dec. 21, 2021

(54) TEST CIRCUIT FOR PREVENTING AN ELECTROSTATIC DISCHARGE DEVICE FROM ELECTRICITY LEAKAGE AND DISPLAY PANEL HAVING SAME

(71) Applicant: WUHAN CHINA STAR OPTOELECTRONICS TECHNOLOGY CO., LTD., Hubei (CN)

(72) Inventor: Ronglei Dai, Hubei (CN)

(73) Assignee: WUHAN CHINA STAR OPTOELECTRONICS TECHNOLOGY CO., LTD., Hubei (CN)

( * ) Notice: Subject to any disclaimer, the term of this patent is extended or adjusted under 35 U.S.C. 154(b) by 157 days.

(21) Appl. No.: 16/615,961

(22) PCT Filed: Apr. 11, 2019

(86) PCT No.: PCT/CN2019/082180
§ 371 (c)(1),
(2) Date: Nov. 22, 2019

(87) PCT Pub. No.: WO2020/107771
PCT Pub. Date: Jun. 4, 2020

(65) Prior Publication Data

US 2020/0234619 A1 Jul. 23, 2020

(30) Foreign Application Priority Data

Nov. 30, 2018 (CN) ..... 201811458693.3

(51) Int. Cl.
*G09G 3/00* (2006.01)

(52) U.S. Cl.
CPC ..... *G09G 3/006* (2013.01); *G09G 2330/04* (2013.01)

(58) Field of Classification Search
CPC ..... G09G 3/006; G09G 2330/04; G09G 2330/06; G09G 2330/12
See application file for complete search history.

(56) References Cited

U.S. PATENT DOCUMENTS

2014/0126094 A1* 5/2014 Duan ..... G09G 5/00 361/56
2015/0206492 A1 7/2015 Lee et al.

FOREIGN PATENT DOCUMENTS

CN 102651547 A 8/2012
CN 106098007 A * 11/2016
CN 106098007 A 11/2016
CN 106098684 A 11/2016

* cited by examiner

*Primary Examiner* — Mark W Regn
(74) *Attorney, Agent, or Firm* — Hauptman Ham, LLP

(57) ABSTRACT

A test circuit for preventing an electrostatic discharge (ESD) device from electricity leakage and a display panel having the same are provided. The test circuit includes a switch module between the ESD device and the display panel to control an electrical connection between the ESD device and the display panel, and prevent the display panel from electricity leakage, so as to reduce power consumption.

16 Claims, 4 Drawing Sheets

TEST CIRCUIT FOR PREVENTING AN ELECTROSTATIC DISCHARGE DEVICE FROM ELECTRICITY LEAKAGE AND DISPLAY PANEL HAVING SAME

FIELD OF INVENTION

The present disclosure relates to display technologies, and more particularly, to a test circuit for preventing an electrostatic discharge device from electricity leakage and a display panel having the same.

BACKGROUND OF INVENTION

Electrostatic discharge (ESD) is a phenomenon of the transfer of electrical charge when objects with different electrostatic potential move closer or contact. Currently, a signal is passed through an ESD device and transmitted to a display panel to prevent the display panel from ESD damage when the display panel is under a lighting test.

When the display panel is not under the lighting test but under normal use, the ESD device is still electrically connected to the display panel. Because of a larger size of the ESD device, the display panel is leaking electricity and has a greater power consumption.

Therefore, there is a need for a test circuit for preventing an electrostatic discharge device from electricity leakage and a display panel having the same to solve the above problems.

SUMMARY OF INVENTION

In view of the above, the present disclosure provides a test circuit for preventing an electrostatic discharge (ESD) device from electricity leakage and a display panel having the same to resolve above-mentioned technical problem.

In order to achieve above-mentioned object of the present disclosure, one embodiment of the disclosure provides a test circuit for preventing an ESD device from electricity leakage. The test circuit is configured to perform a lighting test on a display panel and includes a plurality of ESD devices, a plurality of signal inputting terminals, and a switch module.

Each of the plurality of ESD devices includes a first inputting terminal, a second inputting terminal, and a third inputting terminal.

The plurality of signal inputting terminals include a first signal inputting terminal, a second signal inputting terminal, and a plurality of third signal inputting terminals. The first signal inputting terminal is electrically connected to the first inputting terminal of each ESD device and the display panel. The second signal inputting terminal is electrically connected to the second inputting terminal of each ESD device and the display panel. Each of the third signal inputting terminals is corresponding to one of the ESD device, and each of the third signal inputting terminals is electrically connected to the third inputting terminal of the corresponding ESD device and the display panel.

The switch module is for receiving a control signal and electrically connected to the signal inputting terminals and the display panel. The switch module is configured to electrically disconnect the plurality of ESD devices from display panel by the control signal when the display panel is not under the lighting test.

Each of the plurality of the ESD devices includes a first transistor and a second transistor.

A gate electrode and a source electrode of the first transistor are electrically connected to the first signal inputting terminal. A gate electrode and a source electrode of the second transistor are electrically connected to the second signal inputting terminal. A drain electrode of the first transistor is electrically connected to a drain electrode of the second transistor and the third signal input terminal of the corresponding ESD device.

The display panel includes a first signal receiving terminal, a second signal receiving terminal, and a plurality of third signal receiving terminals.

The first signal receiving terminal is connected to the first signal inputting terminal, the second signal receiving terminal is connected to the second signal inputting terminal, and each of the third signal receiving terminals is connected correspondingly to one of the third signal inputting terminals.

In one embodiment of the disclosure, the switch module includes a first switch unit, a second switch unit, and a plurality of third switch units.

The first switch unit is disposed between the first signal inputting terminal and the first signal receiving terminal, the second switch unit is disposed between the second signal inputting terminal and the second signal receiving terminal. Each of the third switch units is corresponding to one of the plurality of third signal inputting terminals and one of the plurality of third signal receiving terminals. Each of the third switch units is disposed between the third signal inputting terminal of the corresponding ESD device and the third signal receiving terminal of the corresponding ESD device.

In one embodiment of the disclosure, the first switch unit includes a third transistor. A gate electrode of the third transistor is electrically connected to the control signal. A source electrode of the third transistor is electrically connected to the first signal inputting terminal. A drain electrode of the third transistor is electrically connected to the first signal receiving terminal.

The second switch unit includes a fourth transistor. A gate electrode of the fourth transistor is electrically connected to the control signal. A source electrode of the fourth transistor is electrically connected to a second signal inputting terminal. A drain electrode of the fourth transistor is electrically connected to the second signal receiving terminal.

Each of the plurality of third switch units includes a fifth transistor. A gate electrode of the fifth transistor is electrically connected to the control signal. A source electrode of the fifth transistor is electrically connected to the third signal inputting terminal of the corresponding ESD device. A drain electrode of the fifth transistor is electrically connected to the third signal receiving terminal of the corresponding ESD device.

In one embodiment of the disclosure, the first signal inputting terminal and the first inputting terminal of each of the plurality of ESD devices are connected in series, and the second signal inputting terminal and the second inputting terminal of each of the plurality of ESD devices are connected in series.

In one embodiment of the disclosure, the switch module includes a plurality of sixth transistors.

There is one of the sixth transistors disposed between the first signal receiving terminal and the first inputting terminal of the ESD device near the first signal receiving terminal. There is one of the sixth transistors disposed between the first inputting terminals of neighboring ESD devices.

There is one of the sixth transistors disposed between the second signal receiving terminal and the second inputting terminal of the ESD device near the second signal receiving terminal. There is one of the sixth transistors disposed between the second inputting terminals of the neighboring ESD devices.

In one embodiment of the disclosure, a signal at the first signal inputting terminal is a high electrical level signal, and a signal at the second signal inputting terminal is a low electrical level signal.

In one embodiment of the disclosure, all of the transistors are N type transistors or P type transistors.

Furthermore, another embodiment of the disclosure provides a test circuit for preventing the ESD device from electricity leakage. The test circuit is configured to perform a lighting test on a display panel and includes a plurality of ESD devices, a plurality of signal inputting terminals, and a switch module.

Each of the plurality of ESD devices includes a first inputting terminal, a second inputting terminal, and a third inputting terminal.

The plurality of signal inputting terminals include a first signal inputting terminal, a second signal inputting terminal, and a plurality of third signal inputting terminals. The first signal inputting terminal is electrically connected to the first inputting terminal of each ESD device and the display panel. The second signal inputting terminal is electrically connected to the second inputting terminal of each ESD device and the display panel. Each of the third signal inputting terminals is corresponding to one of the ESD device, and each of the third signal inputting terminals is electrically connected to the third inputting terminal of the corresponding ESD device and the display panel.

The switch module is for receiving a control signal and electrically connected to the signal inputting terminals and the display panel. The switch module is configured to electrically disconnect the plurality of ESD devices from display panel by the control signal when the display panel is not under the lighting test.

In one embodiment of the disclosure, each of the plurality of ESD devices includes a first transistor and a second transistor.

A gate electrode and a source electrode of the first transistor are electrically connected the first signal inputting terminal, a gate electrode and a source electrode of the second transistor are electrically connected the second signal inputting terminal, and a drain electrode of the first transistor is electrically connected to a drain electrode of the second transistor and the third signal input terminal of the corresponding ESD device.

In one embodiment of the disclosure, the display panel includes a first signal receiving terminal, a second signal receiving terminal, and a plurality of third signal receiving terminals.

The first signal receiving terminal is connected to the first signal inputting terminal, the second signal receiving terminal is connected to the second signal inputting terminal, and each of the third signal receiving terminal is connected correspondingly to one of the third signal inputting terminals.

In one embodiment of the disclosure, the switch module includes a first switch unit, a second switch unit, and a plurality of third switch units.

The first switch unit is disposed between the first signal inputting terminal and the first signal receiving terminal. The second switch unit is disposed between the second signal inputting terminal and the second signal receiving terminal. Each of the third switch units is corresponding to one of the plurality of third signal inputting terminals and one of the plurality of third signal receiving terminals. The third switch unit is disposed between the third signal inputting terminal of the corresponding ESD device and the third signal receiving terminal of the corresponding ESD device.

In one embodiment of the disclosure, the first switch unit includes a third transistor. A gate electrode of the third transistor is electrically connected to the control signal. A source electrode of the third transistor is electrically connected to the first signal inputting terminal. A drain electrode of the third transistor is electrically connected to the first signal receiving terminal;

The second switch unit includes a fourth transistor. A gate electrode of the fourth transistor is electrically connected to the control signal, a source electrode of the fourth transistor is electrically connected to a second signal inputting terminal, and a drain electrode of the fourth transistor is electrically connected to the second signal receiving terminal.

Each of the plurality of third switch units comprises a fifth transistor. A gate electrode of the fifth transistor is electrically connected to the control signal, a source electrode of the fifth transistor is electrically connected to the third signal inputting terminal of the corresponding ESD device, and a drain electrode of the fifth transistor is electrically connected to the third signal receiving terminal of the corresponding ESD device.

In one embodiment of the disclosure, the first signal inputting terminal and the first inputting terminal of each of the plurality of ESD devices are connected in series, and the second signal inputting terminal and the second inputting terminal of each of the plurality of ESD devices are connected in series.

In one embodiment of the disclosure, the switch module includes a plurality of sixth transistors.

There is one of the sixth transistors disposed between the first signal receiving terminal and the first inputting terminal of the ESD device near the first signal receiving terminal. There is one of the sixth transistors disposed between the first inputting terminals of the neighboring ESD devices.

There is one of the sixth transistors disposed between the second signal receiving terminal and the second inputting terminal of the ESD device near the second signal receiving terminal. There is one of the sixth transistor disposed between the second inputting terminals of the neighboring ESD device.

In one embodiment of the disclosure, a signal at the first signal inputting terminal is a high electrical level signal, and a signal at the second signal inputting terminal is a low electrical level signal.

In one embodiment of the disclosure, all of the transistors are N-type transistor or P-type transistor.

Furthermore, another embodiment of the disclosure provides a display panel including a test circuit using for preventing an ESD device from electricity leakage. The test circuit is configured to perform a lighting test on the display panel and includes a plurality of ESD devices, a plurality of signal inputting terminals, and a switch module.

Each of the plurality of ESD devices includes a first inputting terminal, a second inputting terminal, and a third inputting terminal.

The plurality of signal inputting terminals include a first signal inputting terminal, a second signal inputting terminal and a plurality of third signal inputting terminals. The first signal inputting terminal is electrically connected to the first inputting terminal of each ESD device and the display panel. The second signal inputting terminal is electrically connected to the second inputting terminal of each ESD device and the display panel. Each of the third signal inputting terminals is corresponding to one of the ESD device. Each of the third signal inputting terminals is electrically connected to the third inputting terminal of the corresponding ESD device and the display panel.

The switch module is for receiving a control signal and electrically connected to the signal inputting terminals and the display panel. The switch module is configured to electrically disconnect the plurality of ESD devices from display panel by the control signal when the display panel is not under the lighting test.

In one embodiment of the disclosure, wherein each of the plurality of ESD devices includes a first transistor and a second transistor.

A gate electrode and a source electrode of the first transistor are electrically connected the first signal inputting terminal, a gate electrode and a source electrode of the second transistor are electrically connected the second signal inputting terminal, and a drain electrode of the first transistor is electrically connected to a drain electrode of the second transistor and the third signal input terminal of the corresponding ESD device.

In comparison with prior art, the test circuit for preventing an ESD device from electricity leakage and the display panel having the same of the disclosure provide a switch module controlling connection between the ESD devices and the display panel to prevent the display panel from electricity leakage and to reduce power consumption.

DETAILED DESCRIPTION OF PREFERRED EMBODIMENTS

The following description of the embodiments is provided by reference to the following drawings and illustrates the specific embodiments of the present disclosure. Directional terms mentioned in the present disclosure, such as "up," "down," "top," "bottom," "forward," "backward," "left," "right," "inside," "outside," "side," "peripheral," "central," "horizontal," "peripheral," "vertical," "longitudinal," "axial," "radial," "uppermost" or "lowermost," etc., are merely indicated the direction of the drawings. Therefore, the directional terms are used for illustrating and understanding of the application rather than limiting thereof.

Transistors in all embodiments of the disclosure are thin film transistors or other devices with the same characters. A source electrode and a drain electrode of the transistor of the disclosure are symmetrical, and exchangeable. One of electrodes other than a gate electrode is named as source electrode, and another one of electrodes other than the gate electrode is named as drain electrode. A middle end of the transistor is named as gate electrode according to the drawings, a signal inputted end is named as source electrode, and a signal outputted end is named as drain electrode. The transistors in the disclosure may be P-type transistors or N-type transistors. The P-type transistors are turning on when the gate electrode is at low electrical level, and turning off when the gate electrode is at high electrical level. The N-type transistors are turning on when the gate electrode is at high electrical level, and turning off when the gate electrode is at low electrical level.

Figure 1:
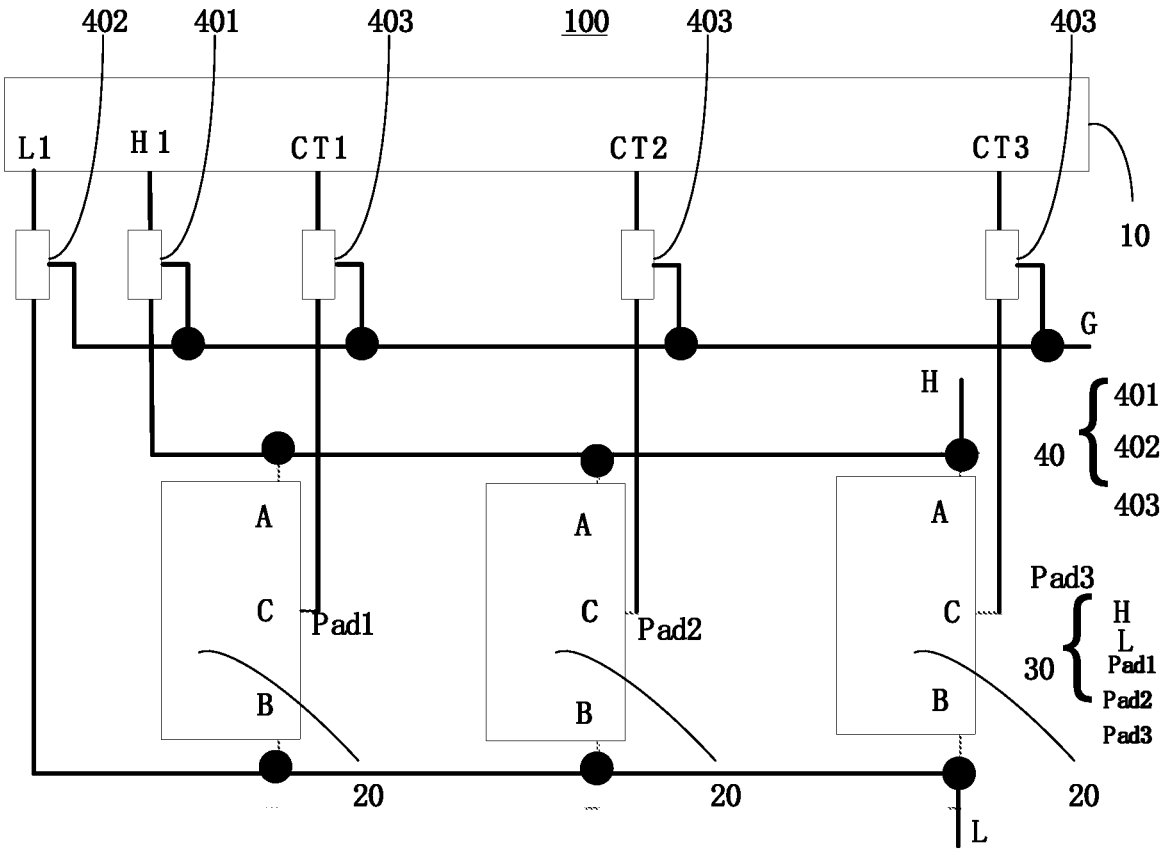
FIG. 1 is a first schematic view of a structure of a test circuit for preventing an electrostatic discharge (ESD) device from electricity leakage according to an embodiment of the present disclosure.

Referring to FIG. 1, FIG. 1 is a first schematic view of a structure of a test circuit for preventing an electrostatic discharge (ESD) device from electricity leakage according to an embodiment of the present disclosure. One embodiment of the disclosure provides a test circuit for preventing an ESD device from electricity leakage. The test circuit is configured to perform a lighting test on a display panel 10 and includes a plurality of ESD devices 20, a plurality of signal inputting terminals 30, and a switch module 40.

Each of the plurality of ESD devices 20 includes a first inputting terminal A, a second inputting terminal B, and a third inputting terminal C. The plurality of signal inputting terminals 30 include a first signal inputting terminal H, a second signal inputting terminal L, and a plurality of third signal inputting terminals Pad1, Pad2, and Pad3. The first signal inputting terminal H is electrically connected to the first inputting terminal A of each ESD device 20 and the display panel 10. The second signal inputting terminal L is electrically connected to the second inputting terminal B of each ESD device 20 and the display panel 10. Each of the third signal inputting terminals Pad1, Pad2, and Pad3 is corresponding to one of the ESD device 20, and each of the third signal inputting terminals Pad1, Pad2, and Pad3 is electrically connected to the third inputting terminal C of the corresponding ESD 20 device and the display panel 10. The switch module 40 is for receiving a control signal G and electrically connected to the signal inputting terminals 30 and the display panel 10.

In the disclosure, the switch module 40 is configured to electrically connect the plurality of ESD devices 20 with the display panel 10 by the control signal G when the display panel 10 is under the lighting test. The switch module 40 is configured to electrically disconnect the plurality of ESD devices 20 from display panel 10 by the control signal G when the display panel 10 is not under the lighting test.

The display panel includes a first signal receiving terminal H1, a second signal receiving terminal L1, and a plurality of third signal receiving terminals CT1, CT2, and CT3. The first signal receiving terminal H1 is connected to the first signal inputting terminal H, the second signal receiving terminal L1 is connected to the second signal inputting terminal L, and each of the third signal receiving terminals CT1, CT2, and CT3 is connected correspondingly to one of the third signal inputting terminals Pad1, Pad2, and Pad3.

In one embodiment of the disclosure, the switch module 40 includes a first switch unit 401, a second switch unit 402, and a plurality of third switch units 403. The first switch unit 401 is disposed between the first signal inputting terminal H and the first signal receiving terminal H1, the second switch unit 402 is disposed between the second signal inputting terminal L and the second signal receiving terminal L1. Each of the third switch units 403 is corresponding to one of the plurality of third signal inputting terminals Pad1, Pad2, and Pad3 and one of the plurality of third signal receiving terminals CT1, CT2, and CT3. Each of the third switch units 403 is disposed between the third signal inputting terminal Pad1, Pad2, and Pad3 of the corresponding ESD device and the third signal receiving terminal CT1, CT2, and CT3 of the corresponding ESD device.

Figure 2:
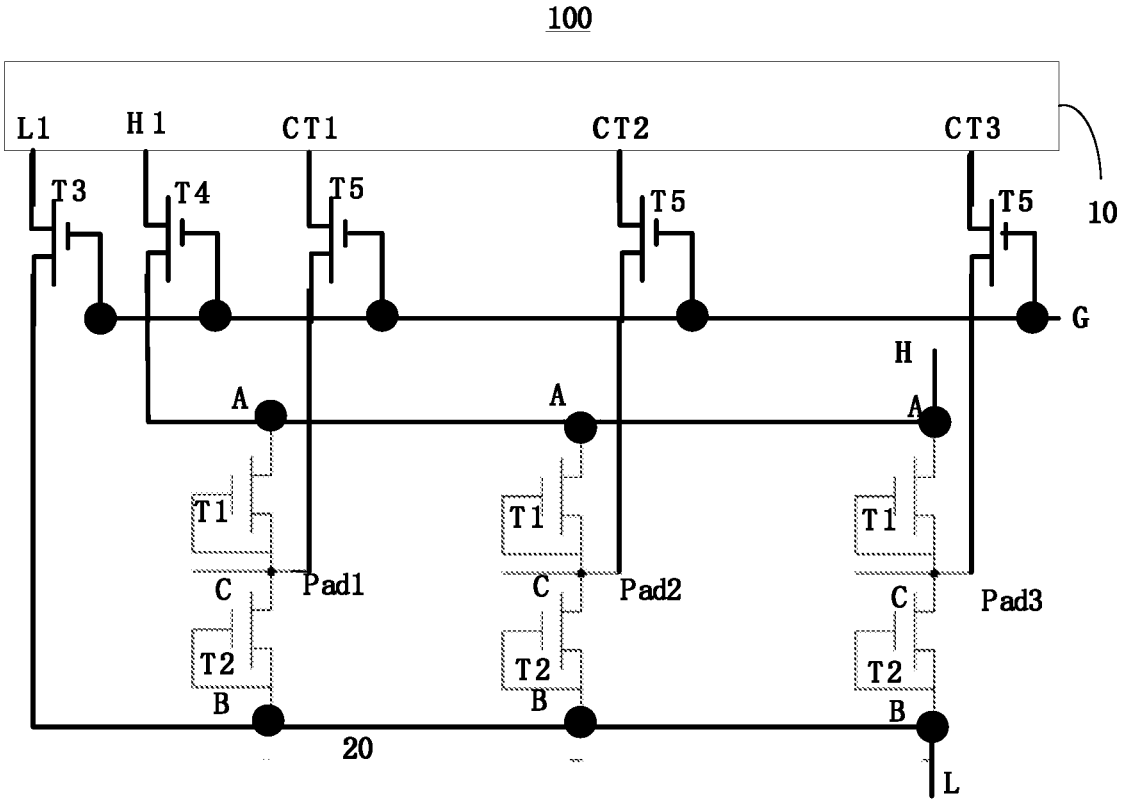
FIG. 2 is a first schematic view of a circuit of the test circuit for preventing an ESD device from electricity leakage according to an embodiment of the present disclosure.

FIG. 2 is a first schematic view of a circuit of the test circuit for preventing an ESD device from electricity leakage according to an embodiment of the present disclosure. Referring to FIGS. 1 and 2, in one embodiment of the disclosure, the first switch unit 401 includes a third transistor T3. A gate electrode of the third transistor T3 is electrically connected to the control signal G. A source electrode of the third transistor T3 is electrically connected to the first signal inputting terminal H. A drain electrode of the third transistor T3 is electrically connected to the first signal receiving terminal H1.

The second switch unit 402 includes a fourth transistor T4. A gate electrode of the fourth transistor T4 is electrically connected to the control signal G. A source electrode of the fourth transistor T4 is electrically connected to a second signal inputting terminal L. A drain electrode of the fourth transistor T4 is electrically connected to the second signal receiving terminal L1.

Each of the plurality of third switch units 403 includes a fifth transistor T5. A gate electrode of the fifth transistor T5 is electrically connected to the control signal G. A source electrode of the fifth transistor T5 is electrically connected to the third signal inputting terminal Pad1, Pad2, and Pad3 of the corresponding ESD device. A drain electrode of the fifth transistor T5 is electrically connected to the third signal receiving terminal CT1, CT2, and CT3 of the corresponding ESD device.

Each of the plurality of the ESD devices 20 includes a first transistor T1 and a second transistor T2.

A gate electrode and a source electrode of the first transistor T1 are electrically connected to the first signal inputting terminal H. A gate electrode and a source electrode of the second transistor T2 are electrically connected to the second signal inputting terminal L. A drain electrode of the first transistor T1 is electrically connected to a drain electrode of the second transistor T2 and the third signal input terminal Pad1, Pad2, and Pad3 of the corresponding ESD device.

In one embodiment of the disclosure, a signal at the first signal inputting terminal H is a high electrical level signal, and a signal at the second signal inputting terminal L is a low electrical level signal. Signals at the third signal inputting terminal Pad1, Pad2, and Pad3 are test signals for the display panel.

Description of working principle of the test circuit for preventing an ESD device from electricity leakage disclosed in FIG. 2 will demonstrate as following, in an example condition that all transistors in the test circuit are N-type transistors.

When the display panel is under the lighting test, the control signal G is at high electrical level, and the first transistor T1, the second transistor T2, and the third transistors T3 are turned on. A signal entering the first signal inputting terminal H will transmit through every one of the first inputting terminals A of the ESD devices 20 to the first signal receiving terminal H1. A signal entering the second signal inputting terminal L will transmit through every one of the second inputting terminals B of the ESD devices 20 to the second signal receiving terminal L1. Signals entering the third signal inputting terminals Pad1, Pad2, and Pad3 will transmit through the corresponding one of the third inputting terminals C of the ESD devices 20 to the corresponding third signal receiving terminals CT1, CT2, and CT3. When the display panel 10 is under the lighting test, the ESD devices 20 will electrically connect with display panel 10 to prevent the display panel 10 from electrostatic damage.

When the display panel 10 is not under the lighting test, the control signal G is at low electrical level, and the first transistor T1, the second transistor T2, and the third transistors T3 are turned off to electrically isolate the ESD devices 20 from the first signal receiving terminal H1, the second signal receiving terminal L1, and the third signal receiving terminals CT1, CT2, and CT3. The ESD devices 20 will electrically disconnect from display panel 10 to prevent the display panel 10 from electricity leakage and to reduce power consumption.

Figure 3:
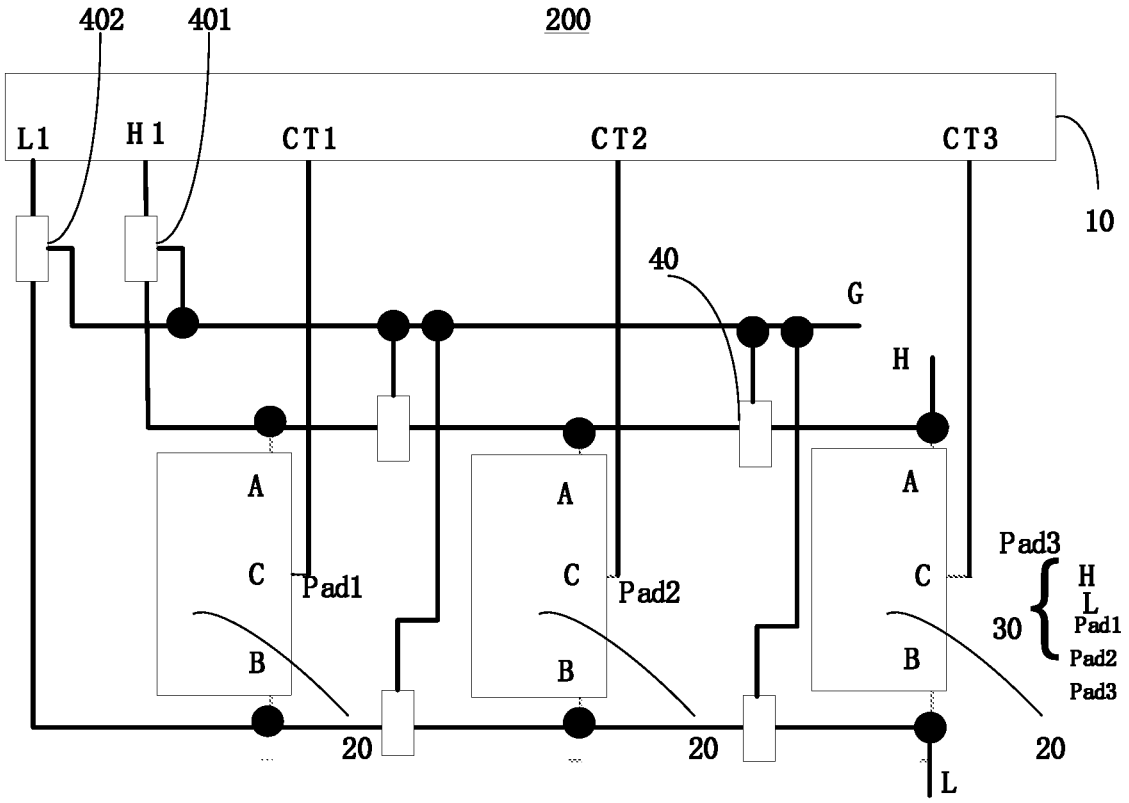
FIG. 3 is a second schematic view of a structure of a test circuit for preventing an ESD device from electricity leakage according to an embodiment of the present disclosure.
Figure 4:
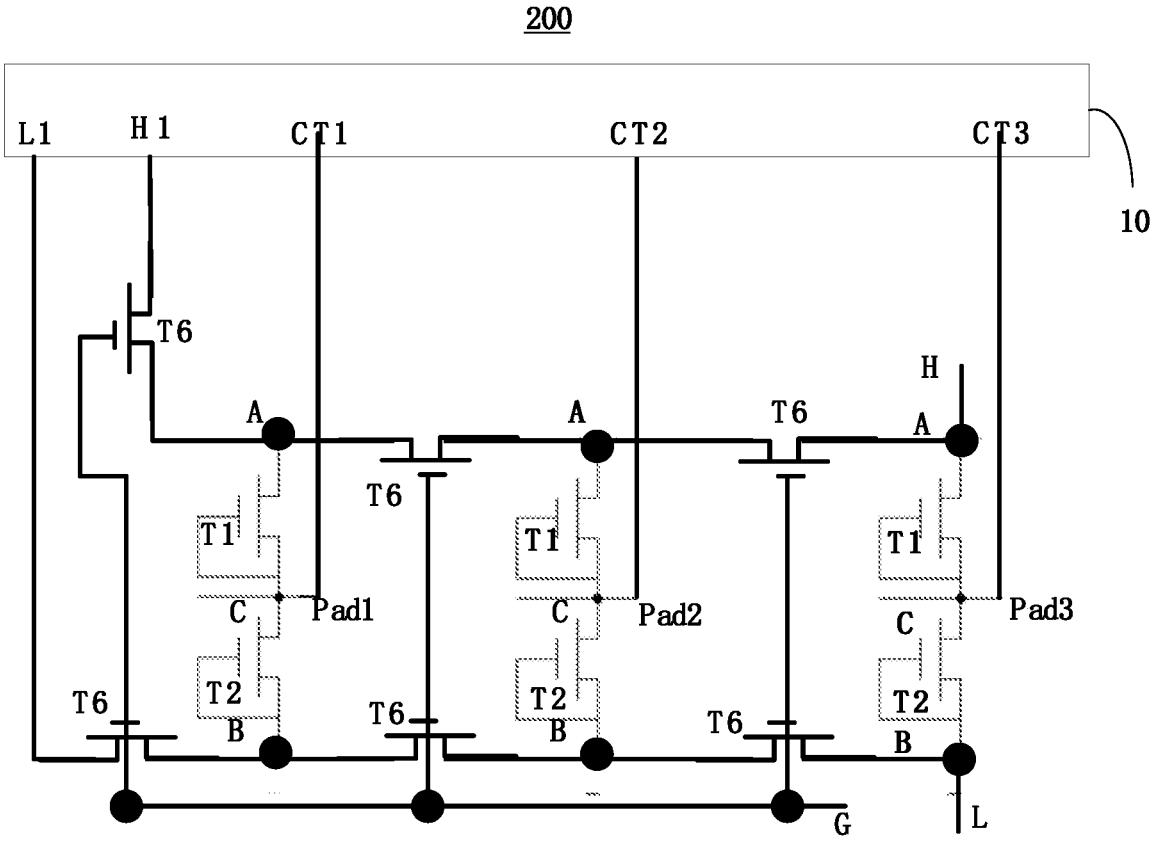
FIG. 4 is a second schematic view of a circuit of the test circuit for preventing an ESD device from electricity leakage according to an embodiment of the present disclosure.

FIG. 3 is a second schematic view of a structure of a test circuit for preventing an ESD device from electricity leakage according to an embodiment of the present disclosure. FIG. 4 is a second schematic view of a circuit of the test circuit for preventing an ESD device from electricity leakage according to an embodiment of the present disclosure. Difference between the test circuit 200 for preventing an ESD device from electricity leakage in FIG. 3 and the test circuit 100 for preventing an ESD device from electricity leakage in FIG. 1 is as following: test circuit 100 for preventing an ESD device from electricity leakage in FIG. 1 is electrically isolating all ESD devices 20 from the display panel; and the test circuit 200 for preventing an ESD device from electricity leakage in FIG. 3 is electrically isolating the first inputting terminal A and the second inputting terminal B from the display panel 10, electrically isolating the first inputting terminals A of neighboring ESD devices 20, and electrically isolating the second inputting terminals B of neighboring ESD devices 20.

Referring to FIGS. 3 and 4, in one embodiment of the disclosure, the first signal inputting terminal H and the first inputting terminal A of each of the plurality of ESD devices 20 are connected in series, and the second signal inputting terminal L and the second inputting terminal B of each of the plurality of ESD devices 20 are connected in series.

In one embodiment of the disclosure, the switch module 40 includes a plurality of sixth transistors T6. There is one of the sixth transistors T6 disposed between the first signal receiving terminal H1 and the first inputting terminal A of the ESD device 20 near the first signal receiving terminal H1. There is one of the sixth transistors T6 disposed between the first inputting terminals A of neighboring ESD devices 20. There is one of the sixth transistors T6 disposed between the second signal receiving terminal L1 and the second inputting terminal B of the ESD device 20 near the second signal receiving terminal L1. There is one of the sixth transistors T6 disposed between the second inputting terminals B of the neighboring ESD devices 20.

Description of working principle of the test circuit for preventing an ESD device from electricity leakage disclosed in FIG. 3 will demonstrate as following, in an example condition that all transistors in the test circuit are N-type transistors.

When the display panel is under the lighting test, the control signal G is at high electrical level, and all of the plurality of sixth transistors T6 are turned on. A signal entering the first signal inputting terminal H will transmit through every one of the first inputting terminals A of the ESD devices 20 to the first signal receiving terminal H1. A signal entering the second signal inputting terminal L will transmit through every one of the second inputting terminals B of the ESD devices 20 to the second signal receiving terminal L1. Signals entering the third signal inputting terminals Pad1, Pad2, and Pad3 will transmit through the corresponding one of the third inputting terminals C of the ESD devices 20 to the corresponding third signal receiving terminals CT1, CT2, and CT3. When the display panel 10 is under the lighting test, the ESD devices 20 will electrically connect with display panel 10 to prevent the display panel 10 from electrostatic damage.

When the display panel 10 is not under the lighting test, the control signal G is at low electrical level, and all of the plurality of sixth transistors T6 are turned off to electrically isolate first inputting terminal A and the second inputting terminal B of the ESD devices 20 from the display panel 10, to electrically isolate first inputting terminals A of neighboring ESD devices 20, and to electrically isolate second inputting terminals B of neighboring ESD devices 20 to prevent the display panel 10 from electricity leakage and to reduce power consumption.

Furthermore, another embodiment of the disclosure provides a display panel including a test circuit using for preventing an ESD device from electricity leakage as aforementioned.

Each of the plurality of ESD devices includes a first inputting terminal, a second inputting terminal, and a third inputting terminal.

The present disclosure has been described by the above embodiments, but the embodiments are merely examples for implementing the present disclosure. It must be noted that the embodiments do not limit the scope of the invention. In contrast, modifications and equivalent arrangements are intended to be included within the scope of the invention.

What is claimed is:

1. A test circuit for preventing an electrostatic discharge (ESD) device from electricity leakage, wherein the test circuit is configured to perform a lighting test on a display panel and comprises:

a plurality of ESD devices, wherein each of the plurality of ESD devices comprises a first inputting terminal, a second inputting terminal, and a third inputting terminal;

a plurality of signal inputting terminals comprising a first signal inputting terminal, a second signal inputting terminal, and a plurality of third signal inputting terminals, wherein the first signal inputting terminal is electrically connected to the first inputting terminal of each ESD device and the display panel, the second signal inputting terminal is electrically connected to the second inputting terminal of each ESD device and the display panel, each of the third signal inputting terminals is corresponding to one of the ESD device, and each of the third signal inputting terminals is electrically connected to the third inputting terminal of the corresponding ESD device and the display panel; and a switch module for receiving a control signal and electrically connected to the signal inputting terminals and the display panel, wherein the switch module is configured to electrically disconnect the plurality of ESD devices from display panel by the control signal when the display panel is not under the lighting test, wherein the switch module comprises a first switch unit, a second switch unit and a plurality of third switch units;

wherein each of the plurality of the ESD devices comprises a first transistor and a second transistor;

wherein a gate electrode and a source electrode of the first transistor are electrically connected the first signal inputting terminal, a gate electrode and a source electrode of the second transistor are electrically connected the second signal inputting terminal, and a drain electrode of the first transistor is electrically connected to a drain electrode of the second transistor and the third signal input terminal of the corresponding ESD device;

wherein the display panel comprises a first signal receiving terminal, a second signal receiving terminal, and a plurality of third signal receiving terminals;

wherein the first signal receiving terminal is connected to the first signal inputting terminal, the second signal receiving terminal is connected to the second signal inputting terminal, and each of the third signal receiving terminals is connected correspondingly to one of the third signal inputting terminals; and wherein the first switch unit is disposed between the first signal inputting terminal and the first signal receiving terminal, the second switch unit is disposed between the second signal inputting terminal and the second signal receiving terminal, each of the third switch units is corresponding to one of the plurality of third signal inputting terminals and one of the plurality of third signal receiving terminals, and each of the third switch units is disposed between the third signal inputting terminal of the corresponding ESD device and the third signal receiving terminal of the corresponding ESD device.

2. The test circuit for preventing the ESD device from electricity leakage according to claim 1, wherein the first switch unit comprises a third transistor, a gate electrode of the third transistor is electrically connected to the control signal, a source electrode of the third transistor is electrically connected to the first signal inputting terminal, and a drain electrode of the third transistor is electrically connected to the first signal receiving terminal;

wherein the second switch unit comprises a fourth transistor, a gate electrode of the fourth transistor is electrically connected to the control signal, a source electrode of the fourth transistor is electrically connected to a second signal inputting terminal, and a drain electrode of the fourth transistor is electrically connected to the second signal receiving terminal; and wherein each of the plurality of third switch units comprises a fifth transistor, a gate electrode of the fifth transistor is electrically connected to the control signal, a source electrode of the fifth transistor is electrically connected to the third signal inputting terminal of the corresponding ESD device, and a drain electrode of the fifth transistor is electrically connected to the third signal receiving terminal of the corresponding ESD device.

3. The test circuit for preventing the ESD device from electricity leakage according to claim 1, wherein the first signal inputting terminal and the first inputting terminal of each of the plurality of ESD devices are connected in series, and the second signal inputting terminal and the second inputting terminal of each of the plurality of ESD devices are connected in series.

4. The test circuit for preventing from the ESD device from electricity leakage according to claim 3, wherein the switch module comprises a plurality of sixth transistors;

wherein there is one of the sixth transistors disposed between the first signal receiving terminal and the first inputting terminal of the ESD device near the first signal receiving terminal, and there is one of the sixth transistors disposed between the first inputting terminals of neighboring ESD devices; and wherein there is one of the sixth transistors disposed between the second signal receiving terminal and the second inputting terminal of the ESD device near the second signal receiving terminal, and there is one of the sixth transistors disposed between the second inputting terminals of the neighboring ESD devices.

5. The test circuit for preventing the ESD device from electricity leakage according to claim 1, wherein a signal at the first signal inputting terminal is a high electrical level signal, and a signal at the second signal inputting terminal is a low electrical level signal.

6. The test circuit for preventing the ESD device from electricity leakage according to claim 1, wherein all of the transistors are N-type transistors or P-type transistors.

7. A test circuit for preventing the ESD device from electricity leakage, wherein the test circuit is configured to perform a lighting test on a display panel and comprises:

a plurality of ESD devices, wherein each of the plurality of ESD devices comprises a first inputting terminal, a second inputting terminal, and a third inputting terminal;

a plurality of signal inputting terminals comprising a first signal inputting terminal, a second signal inputting terminal, and a plurality of third signal inputting terminals, wherein the first signal inputting terminal is electrically connected to the first inputting terminal of each ESD device and the display panel, the second signal inputting terminal is electrically connected to the second inputting terminal of each ESD device and the display panel, each of the third signal inputting terminals is corresponding to one of the ESD device, and each of the third signal inputting terminals is electrically connected to the third inputting terminal of the corresponding ESD device and the display panel; and a switch module for receiving a control signal and electrically connected to the signal inputting terminals and the display panel, wherein the switch module is configured to electrically disconnect the plurality of ESD devices from display panel by the control signal when the display panel is not under the lighting test, wherein the switch module comprises a first switch unit, a second switch unit, and a plurality of third switch units;

wherein the display panel comprises a first signal receiving terminal, a second signal receiving terminal, and a plurality of third signal receiving terminals; and wherein the first switch unit is disposed between the first signal inputting terminal and the first signal receiving terminal, the second switch unit is disposed between the second signal inputting terminal and the second signal receiving terminal, each of the third switch units is corresponding to one of the plurality of third signal inputting terminals and one of the plurality of third signal receiving terminals, and the third switch unit is disposed between the third signal inputting terminal of the corresponding ESD device and the third signal receiving terminal of the corresponding ESD device.

8. The test circuit for preventing the ESD device from electricity leakage according to claim 7, wherein the first signal receiving terminal is connected to the first signal inputting terminal, the second signal receiving terminal is connected to the second signal inputting terminal, and each of the third signal receiving terminal is connected correspondingly to one of the third signal inputting terminals.

9. The test circuit for preventing the ESD device from electricity leakage according to claim 8, wherein the first signal inputting terminal and the first inputting terminal of each of the plurality of ESD devices are connected in series, and the second signal inputting terminal and the second inputting terminal of each of the plurality of ESD devices are connected in series.

10. The test circuit for preventing the ESD device from electricity leakage according to claim 9, wherein the switch module comprises a plurality of sixth transistors;

wherein there is one of the sixth transistors disposed between the first signal receiving terminal and the first inputting terminal of the ESD device near the first signal receiving terminal, and there is one of the sixth transistors disposed between the first inputting terminals of the neighboring ESD devices; and wherein there is one of the sixth transistors disposed between the second signal receiving terminal and the second inputting terminal of the ESD device near the second signal receiving terminal, and there is one of the sixth transistor disposed between the second inputting terminals of the neighboring ESD device.

11. The test circuit for preventing the ESD device from electricity leakage according to claim 10, wherein all of the transistors are N-type transistor or P-type transistor.

12. The test circuit for preventing the ESD device from electricity leakage according to claim 7, wherein the first switch unit comprises a third transistor, a gate electrode of the third transistor is electrically connected to the control signal, a source electrode of the third transistor is electrically connected to the first signal inputting terminal, and a drain electrode of the third transistor is electrically connected to the first signal receiving terminal;

wherein the second switch unit comprises a fourth transistor, a gate electrode of the fourth transistor is electrically connected to the control signal, a source electrode of the fourth transistor is electrically connected to a second signal inputting terminal, and a drain electrode of the fourth transistor is electrically connected to the second signal receiving terminal; and wherein each of the plurality of third switch units comprises a fifth transistor, a gate electrode of the fifth transistor is electrically connected to the control signal, a source electrode of the fifth transistor is electrically connected to the third signal inputting terminal of the corresponding ESD device, and a drain electrode of the fifth transistor is electrically connected to the third signal receiving terminal of the corresponding ESD device.

13. The test circuit for preventing the ESD device from electricity leakage according to claim 7, wherein a signal at the first signal inputting terminal is a high electrical level signal, and a signal at the second signal inputting terminal is a low electrical level signal.

14. The test circuit for preventing the ESD device from electricity leakage according to claim 12, wherein all of the transistors are N-type transistor or P-type transistor.

15. A display panel comprising a test circuit using for preventing an ESD device from electricity leakage, wherein the test circuit is configured to perform a lighting test on the display panel, and comprises:

a plurality of ESD devices, wherein each of the plurality of ESD devices comprises a first inputting terminal, a second inputting terminal, and a third inputting terminal;

a plurality of signal inputting terminals comprising a first signal inputting terminal, a second signal inputting terminal, and a plurality of third signal inputting terminals, wherein the first signal inputting terminal is electrically connected to the first inputting terminal of each ESD device and the display panel, the second signal inputting terminal is electrically connected to the second inputting terminal of each ESD device and the display panel, each of the third signal inputting terminals is corresponding to one of the ESD device, and each of the third signal inputting terminals is electrically connected to the third inputting terminal of the corresponding ESD device and the display panel; and a switch module for receiving a control signal and electrically connected to the signal inputting terminals and the display panel, wherein the switch module is configured to electrically disconnect the plurality of ESD devices from display panel by the control signal when the display panel is not under the lighting test, wherein the switch module comprises a first switch unit, a second switch unit, and a plurality of third switch units;

wherein the display panel comprises a first signal receiving terminal, a second signal receiving terminal, and a plurality of third signal receiving terminals; and wherein the first switch unit is disposed between the first signal inputting terminal and the first signal receiving terminal, the second switch unit is disposed between the second signal inputting terminal and the second signal receiving terminal, each of the third switch units is corresponding to one of the plurality of third signal inputting terminals and one of the plurality of third signal receiving terminals, and each of the third switch units is disposed between the third signal inputting terminal of the corresponding ESD device and the third signal receiving terminal of the corresponding ESD device.

16. The display panel according to claim 15, wherein each of the plurality of ESD devices comprises a first transistor and a second transistor; and wherein a gate electrode and a source electrode of the first transistor are electrically connected the first signal inputting terminal, a gate electrode and a source electrode of the second transistor are electrically connected the second signal inputting terminal, and a drain electrode of the first transistor is electrically connected to a drain electrode of the second transistor and the third signal input terminal of the corresponding ESD device.

* * * * *